US009599357B2

(12) United States Patent
Vogel

(10) Patent No.: US 9,599,357 B2
(45) Date of Patent: Mar. 21, 2017

(54) AIR HANDLING SYSTEM AND METHODS OF OPERATING SAME

(71) Applicant: John Vogel, Saint Louis, MO (US)

(72) Inventor: John Vogel, Saint Louis, MO (US)

(73) Assignee: Vogel Sheet Metal and Heating, Inc, Fenton, MO (US)

( * ) Notice: Subject to any disclaimer, the term of this patent is extended or adjusted under 35 U.S.C. 154(b) by 621 days.

(21) Appl. No.: 13/890,741

(22) Filed: May 9, 2013

(65) Prior Publication Data

US 2013/0303073 A1 Nov. 14, 2013

Related U.S. Application Data

(60) Provisional application No. 61/644,750, filed on May 9, 2012.

(51) Int. Cl.

| | |
|---|---|
| ***F24F 7/00*** | (2006.01) |
| ***F41J 11/00*** | (2009.01) |
| ***F24F 3/044*** | (2006.01) |

(52) U.S. Cl.

CPC ..... *F24F 7/00* (2013.01); *F24F 3/0442* (2013.01); *F41J 11/00* (2013.01)

(58) Field of Classification Search

CPC ..... F41J 11/00
USPC ..... 454/187, 228, 237, 49
See application file for complete search history.

(56) References Cited

U.S. PATENT DOCUMENTS

| | | | | |
|---|---|---|---|---|
| 4,114,521 | A * | 9/1978 | Busch | F24F 7/06 118/326 |
| 4,164,901 | A | 8/1979 | Everett | |
| 5,846,128 | A * | 12/1998 | Kramer | B01D 46/0086 454/229 |
| 6,427,454 | B1 * | 8/2002 | West | F24F 3/153 62/176.1 |

OTHER PUBLICATIONS

DHHS (NIOSH) Publication No. 2009-136, "Preventing Occupational Exposures to Lead and Noise at Indoor Firing Ranges", Apr. 2009, 32 pages.

* cited by examiner

*Primary Examiner* — Avinash Savani
*Assistant Examiner* — Vivek Shirsat
(74) *Attorney, Agent, or Firm* — Armstrong Teasdale LLP

(57) ABSTRACT

An air handling system for handling air and contaminants within an indoor gun range is provided. The air handling system includes a conditioning unit coupled to the indoor gun range. An air supply assembly is coupled in flow communication to the conditioning unit and the indoor gun range, wherein the air supply assembly is configured to discharge air from the conditioning unit and into the indoor gun range. The air handling system includes an air recirculation assembly coupled in flow communication to the air supply assembly and the indoor gun range. The air recirculation assembly is configured to recirculate at least one of a first amount of discharged air and a second amount of discharged air to the air supply assembly. An air exhaust assembly is coupled in flow communication to the indoor gun range.

20 Claims, 3 Drawing Sheets

AIR HANDLING SYSTEM AND METHODS OF OPERATING SAME

CROSS REFERENCE TO RELATED APPLICATIONS

This application is a U.S. non-provisional patent application of and claiming priority to U.S. Provisional Patent Application Ser. No. 61/644,750 filed on May 9, 2012, which is hereby incorporated by reference in its entirety.

The present disclosure relates generally to an air handling system, and more particularly, to methods and systems for tempering, filtering and ventilating an environment adapted for firearm and/or explosive discharges.

Indoor firing ranges may present particular problems for indoor air quality as well as the quality of air exhausted to ambient outdoor air because firearms can discharge chemicals into the environment. These chemicals may include: boron, sodium, aluminum, silicon, phosphorus, sulphur, chlorine, potassium, calcium, titanium, chromium, manganese, iron, nickel, copper, zinc, arsenic, selenium, silver, cadmium, antimony, telrium, mercury, thallium, bismuth, lead solids and lead oxides as well as unburned gun powder and carbon monoxide gas. Some of these elements may be toxic, and continued exposure to them, as by a range employee, may lead to health problems or even death. Moreover, these contaminants should not be released directly into the outdoor environment at unacceptable levels.

Standards for lead exposure and air quality have been developed by the Occupational Safety and Health Administration (OSHA) and the Environmental Protection Agency (EPA) as well as state and local air quality and environmental protection authorities. Laws and regulations have been established which provide guidelines to ensure that contaminants present in indoor firing ranges are properly controlled to ensure the safety of the shooters, employees and other persons who may be present within the range area. Further, the standards provide guidelines to ensure that fully contaminated air is not discharged into the atmosphere, but, instead, that contaminant levels are reduced to minimally acceptable levels.

Some existing indoor gun ranges may have poorly designed ventilation systems, with either no or limited filtration such that some known ranges may not comply with existing clean air standards. Moreover, some conventional indoor gun ranges may utilize equipment to condition outdoor air prior to venting the outdoor air into the gun range. Conditioning equipment, however, can be expensive with regard to upfront costs, and may also include high legacy operating costs during the winter and summer months.

BRIEF SUMMARY

In one aspect, an air handling system for handling air and contaminants within an indoor gun range is provided. The air handling system includes a conditioning unit coupled to the indoor gun range. An air supply assembly is coupled in flow communication to the conditioning unit and the indoor gun range, wherein the air supply assembly is configured to discharge air from the conditioning unit and into the indoor gun range. The air handling system includes an air recirculation assembly coupled in flow communication to the air supply assembly and the indoor gun range. The air recirculation assembly includes a first vent and a second vent. The first vent is configured to receive a first amount of discharged air and the second vent is configured to receive a second amount of discharged air, wherein the first amount of discharged air is different than the second amount of discharged. The air recirculation assembly is configured to recirculate at least one of the first amount of discharged air and the second amount of discharged air to the air supply assembly. An air exhaust assembly is coupled in flow communication to the indoor gun range, wherein the air exhaust assembly is configured to facilitate exhausting a third amount of the discharged air and the contaminants out of the indoor gun range.

In another aspect, an indoor gun range is provided. The indoor gun range includes an enclosure having an uprange end, a downrange end, a floor, a roof and opposing side walls. A conditioning unit is coupled to the enclosure. An air supply assembly is coupled in flow communication to the conditioning unit and the uprange end, wherein the air supply assembly is configured to discharge air from the conditioning unit and into the uprange end. The indoor gun range includes an air recirculation assembly coupled in flow communication to the air supply assembly and to at least one of the uprange end and the downrange end. The air recirculation assembly includes a first vent and a second vent. The first vent is configured to receive a first amount of discharged air and the second vent is configured to receive a second amount of discharged air. The air recirculation assembly is configured to recirculate at least one of the first amount of discharged air and the second amount of discharged air to the air supply assembly. An air exhaust assembly is coupled in flow communication to the downrange end, wherein the air exhaust assembly is configured to facilitate exhausting a third amount of the discharged air and the contaminants out of the indoor gun range.

Still further, in another aspect, method of handling air and contaminants of an indoor gun range is provided. The method includes supplying tempered air from an air handling unit and discharging the tempered air into a shooter position within the indoor gun range. The method further includes re-circulating a first amount of the discharged air into the air handling unit and re-circulating a second amount of the discharged air into the air handling unit, wherein the second amount of discharged air being less than the first amount of discharged air. A third amount of discharged air is exhausted out of the indoor gun range.

Although specific features of various embodiments may be shown in some drawings and not in others, this is for convenience only. Any feature of any drawing may be referenced and/or claimed in combination with any feature of any other drawing.

DETAILED DESCRIPTION OF THE INVENTION

The embodiments described herein relate to air handling system and methods of operating air handling system. More particularly, the embodiments relate to an air recirculation assembly and an air exhaust assembly coupled to an indoor facility. The embodiments relate to methods, systems and/or apparatus for controlling air flow and filtering contaminants of the air flow. It should be understood that the embodiments described herein include a variety of indoor facilities, and further understood that the description and figures that utilize an indoor gun range are exemplary only.

Figure 1:
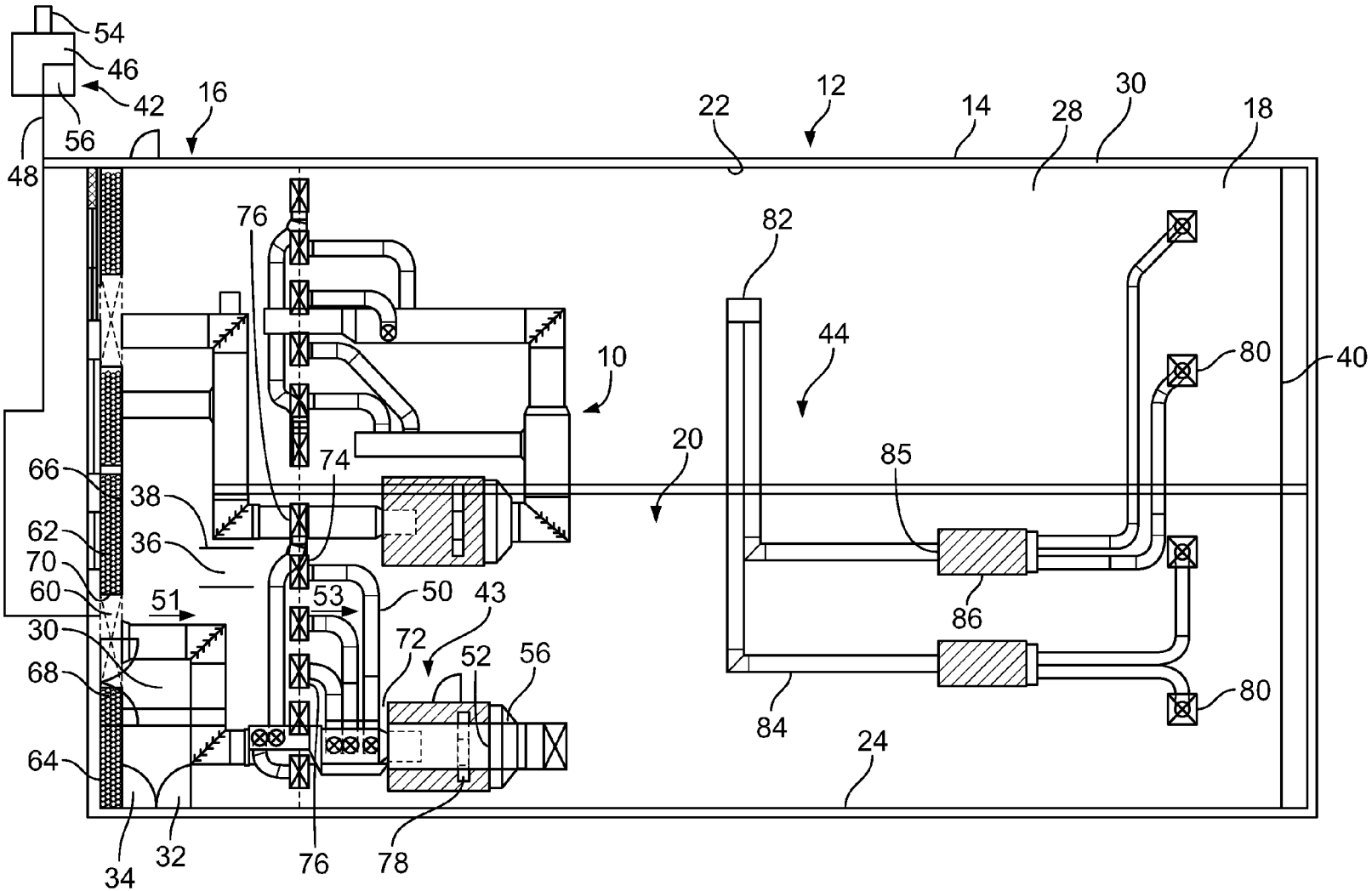
FIG. 1 is a plan view of an exemplary air handling system that is used with an indoor gun range.

FIG. 1 is a plan view of an air handling system 10 coupled to an indoor gun range 12. Gun range 12 includes an enclosure 14 having an uprange end 16, a downrange end 18, a range area 20 located between uprange end 16 and downrange end 18. Gun range 10 further includes spaced, parallel side walls 22 and 24, a ceiling 26 and a floor 28.

Uprange end 16 includes a shooter area 30 where the shooters (not shown) and range employees (not shown) meet and set up. Shooter area 30 includes a door 32 leading into a ready room 34, ready room 34 is configured to store shooters' equipment. Uprange end 16 further includes a plurality of shooter positions 36 commonly called "points", wherein shooter positions 36 are separated from ready room 34 by a painted line (not shown) on floor 28. Typically, there is a wall enclosure 38 on each side of individual shooter position 36 which facilitates shielding shooters against side spray of unburned gun powder and serves to muffle a muzzle blast of a discharged firearm.

Within range area 20, lanes (not shown) are marked by painted lines on floor 28 and extend from shooter position 36 to downrange end 18. Downrange end 18 includes a target location (not shown) and a bullet trap 40 to capture bullets (not shown) fired from uprange end 16. An overhead trolley system (not shown) carries targets (not shown) from downrange end 18 back and forth to the shooter positions 36 for inspection and changing.

Air handling system 10 includes an air supply assembly 42, an air recirculation assembly 43, and an air exhaust assembly 44, wherein air supply assembly 42 is coupled to enclosure 14 near shooters area 30, air recirculation assembly 43 is coupled to enclosure 14 near range area 20 and air exhaust assembly 44 is coupled to enclosure 14 near downrange end 18. In other embodiments, air supply assembly 42, air recirculation assembly 43 and air exhaust assembly 44 may couple to enclosure 14 at other variable locations. During use of range 12, firearm discharge generates small particles of bullet material, including lead and lead oxides, and quantities of unburned or partially burned gun powder, chemicals and combustion gases into the air. Air handling system 10 is configured to facilitate filtering and re-circulating air flow in shooter's area 30. Moreover, air handling system 10 is configured to facilitate exhausting air and contaminants from and out of range 12.

Air supply assembly 42 includes an air handling unit 46 and a supply duct 48 which is coupled in flow communication to air handling unit 46. Air handling unit 46 is generally mounted on a roof of gun range 12 at a location variable with each installation. Alternatively, air handling unit 46 can be mounted to enclosure 14 at other variable locations such as, for example, sidewalls 22 and 24. Air handling unit 46 includes an air inlet vent 54 and a heating and air conditioning unit 56. Air inlet vent 54 is configured to channel outside air in flow communication with heating and air conditioning unit 56. Conditioning unit 56 is configured to facilitate tempering the temperature of air, for example heating or cooling air, depending on required temperature parameters. Air conditioning unit 56 is further configured to force tempered air into supply duct 48.

Air supply assembly 42 further includes at least one filter (not shown) coupled in flow communication to conditioning unit 56. Filter is positioned between conditioning unit 56 and supply duct 48. In the exemplary embodiment, filter includes a high efficiency particulate air (HEPA) rated filter. In other embodiments, any filter configuration and/or rating can be used that enables air handling system 10 to function as described herein.

Air supply assembly 42 includes a mixing plenum 60 and at least one discharge vent 62. Supply duct 48 is coupled in flow communication to conditioning unit 56 and is coupled in flow communication to mixing plenum 60. Supply duct 48 is configured to channel air from conditioning unit 56 and into mixing plenum 60. Mixing plenum 60 is coupled in flow communication with at least one discharge vent 62. In the exemplary embodiment, at least one discharge vent 62 includes a first discharge vent 64 and a second discharge vent 66. Alternatively, any number of discharge vents 62 can be used that enables air handling system 10 to function as described herein. Mixing plenum 60 is configured to distribute and/or discharge air from supply duct 48 and into first and second discharge vents 64 and 66. First discharge vent 64 is coupled in flow communication with a first side 68 of mixing plenum 60 and second discharge vent 66 is coupled in flow communication with a second side 70 of mixing plenum 60.

Discharge vents 62 are positioned within shooter area 30 at an elevated position with respect to floor 28. In the exemplary embodiment, discharge vents 62 are positioned adjacent ceiling 26 and orientated toward shooter position 36. Alternatively, discharge vent 62 can be located within shooter area 30 at any position and/or orientation to enable system 10 to function as described herein. First and second discharge vents 64 and 66 are configured to channel air from mixing plenum 60, across shooter position 36 and discharge air 51 into range area 20. Air supply assembly 42 further includes a temperature sensor (not shown) in shooters area 30. Temperature sensor is configured to measure, monitor and/or report the temperature of discharge air 51 within shooter area 30.

Air recirculation assembly 43 includes a first return duct 50 that is configured to return discharge air 51 that is present in range area 20 to at least one of air handling unit 46 and mixing plenum 60 via a fan 52. First return duct 50 includes a first end 72 coupled in flow communication to air handling unit 46 and/or supply duct 48 and a second end 74 coupled in flow communication to a first return vent 76. First return vent 76 is configured in flow communication with range area 20. First return duct 50 includes a filter 78 located between supply duct 48 and first return vent 76, wherein first return vent 76 is coupled in flow communication to first return duct 50. In the exemplary embodiment, filter 78 includes a HEPA rated filter. In other embodiments, any filter configuration and/or rating can be used that enables air handling system 10 to function as described herein.

First return vent 76 is positioned in range area 20 and between shooter position 36 and downrange end 18 at an elevated position with respect to floor 28. First return vent 76 is positioned adjacent ceiling 26 and orientated toward range area 20. First return vent 76 can include any number of return vents 76 that enables air handling system 10 to function as described herein. Moreover, first return vent 76 can be located in any position and/or orientation within enclosure 14 to enable system 10 to function as described herein.

First return vent 76 is configured to receive and/or channel a first amount of discharged air 53 and contaminates present in range area 20 and into first return duct 50. Because first return duct 50 is in flow communication with air handling unit 46 and/or supply duct 48, fan 52 is configured to further create a negative pressure with first return duct 50 to draw air and contaminants into first return duct 50. First return duct 50 channels first amount of discharged air 53 and contaminants through filter 78 which facilitates removing contaminants from air. First return duct 50 channels filtered first amount of discharged air 53 into at least one of supply duct 48 and mixing plenum 60 to facilitate re-circulating return air with supply air.

Air exhaust assembly 44 includes an exhaust inlet/intake vent 80, an exhaust outlet vent 82 and exhaust duct 84 coupled in flow communication to exhaust inlet vent 80 and exhaust outlet vent 82. In the exemplary embodiment, air exhaust assembly 44 includes a trap exhaust fan 85 coupled in flow communication to exhaust duct 84. Exhaust inlet vent 80 is positioned within range area 20 and between first return vent 76 and downrange end 18 at an elevated position with respect to floor 28. In the exemplary embodiment, exhaust inlet vent 80 is positioned adjacent downrange end 18. Exhaust inlet vent 80 is positioned adjacent to ceiling 26 and orientated toward range area 20 and in flow communication with downrange end 18. Exhaust inlet vent 80 can include any number of vents that enables air handling system 10 to function as described. Exhaust inlet vent 80 can be located within enclosure 14 in any position and/or orientation to enable system 10 to function as described herein.

Exhaust inlet vent 80 is configured to receive air 51 and contaminants that flow past first return duct 50 and/or first return vent 76 and into range area 20 and/or downrange end 18. Exhaust inlet vent 80 is configured to channel air 51 and contaminants into exhaust duct 84. Exhaust duct 84 includes a filter 86 located between exhaust inlet vent 80 and exhaust outlet vent 82. In the exemplary embodiment, filter 86 includes a HEPA rated filter. The efficiency of filter 86 can be regulated by local code authority. In other embodiments, any filter configuration and/or rating can be used that facilitates air handling system 10 to function as described herein. Exhaust duct 84 is configured to channel air 51 through filter 86 and out of exhaust outlet vent 82. Filter 86 is configured to facilitate capturing a predetermined amount of contaminants from air 51 prior to air 51 exiting exhaust outlet vent 82 and into outside environment.

Figure 2:
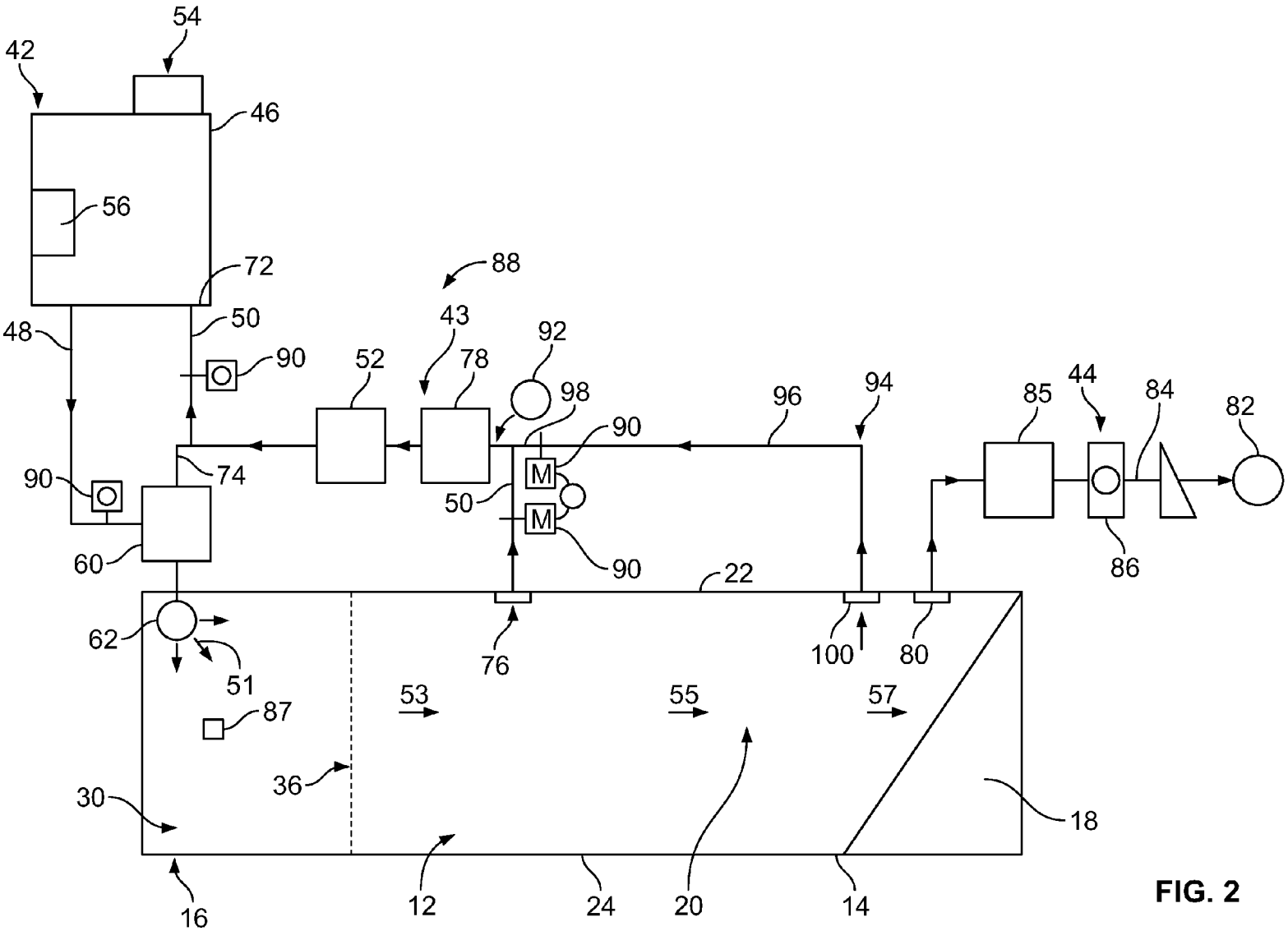
FIG. 2 is a schematic view of another exemplary air handling system that is used with an indoor gun range.

FIG. 2 is a schematic view of another exemplary air handling system 88 that is used with indoor gun range 12. In FIG. 2, same or similar components include the same element numbers shown in FIG. 1. Air handling system 88 is configured to facilitate filtering, re-circulating and/or removing air flow in shooters area 30 and within range 12. Moreover, air handling system 88 is configured to facilitate filtering and exhausting air and/or contaminants from range 12. Air handling system 88 includes air supply assembly 42, air recirculation assembly 43 and air exhaust assembly 44, wherein air supply assembly 42 is coupled to enclosure 14 adjacent shooters area 30, air recirculation assembly 43 is coupled to enclosure near range area 20 and air exhaust assembly 44 is coupled to enclosure 14 near downrange end 18. In other embodiments, air supply assembly 42, air recirculation assembly 43 and air exhaust assembly 44 may couple to enclosure 14 at other variable locations.

Air supply assembly 42 includes air handling unit 46 and supply duct 48 which is coupled in flow communication to air handling unit 46. Air handling unit 46 is generally mounted on a roof of gun range 12 at a location variable with each installation. Alternatively, air handling unit 46 can be mounted to enclosure 14 at other variable locations such as, for example, sidewalls 22 and 24. Air handling unit 46 includes air inlet vent 54 and heating and air conditioning unit 56. In the exemplary embodiment, outside air intake is balanced to a minimum of 25% of circulated air volume. Alternatively, outside air intake can be balanced to any percentage of circulated air volume to enable air handling system 88 to function as described herein. Air inlet vent 54 is configured to channel outside air in flow communication with heating and air conditioning unit 56. Conditioning unit 56 is configured to facilitate tempering the temperature of air, for example heating or cooling air, depending on required temperature parameters.

Air supply assembly 42 includes mixing plenum 60 and at least one discharge vent 62. Air supply assembly 42 includes a balancing damper 90 coupled in flow communication to supply duct 48. Balancing damper 90 can be manually and/or automatically controlled. Supply duct 48 is coupled in flow communication to conditioning unit 56 and is coupled in flow communication to mixing plenum 60. Supply duct 48 is configured to channel and/or discharge air 51 from conditioning unit 56 and into mixing plenum 60. Mixing plenum 60 is coupled in flow communication with at least one discharge vent 62. In the exemplary embodiment, discharge vent 62 includes a perforated filtered air discharge duct. Alternatively, discharge vent 62 can include any configuration to enable system 10 to function as described herein.

Discharge vent 62 is positioned within shooter area 30 at an elevated position with respect to floor (not shown). In the exemplary embodiment, discharge vent 62 is positioned adjacent ceiling (not shown) and orientated toward shooter position 36. Alternatively, discharge vent 62 can be located within shooter area 30 at any position and/or orientation to enable system 10 to function as described herein. Discharge vent 62 is configured to channel air 51 from mixing plenum 60, across shooter position 36 and discharge air 51 into range area 20. Air supply assembly 42 includes a temperature sensor 87 located in shooters area 30. Temperature sensor 87 is configured to measure, monitor and/or report the temperature of discharged air 51 within shooter area 30.

Air recirculation assembly 43 includes a primary circulated dirty air pickup/return system wherein first return duct 50 is configured to return first amount of discharged air 51 present in range area 20 to at least one of air handling unit 46 and mixing plenum 60. First return duct 50 includes first end 72 coupled in flow communication to air handling unit 46 and a second end 74 coupled in flow communication to mixing plenum 60. First return vent 76 is coupled to first return duct 50 and in flow communication with first return duct 50 and range area 20. First return duct 50 includes filter 78 coupled in flow communication to and located between supply duct 48 and first return vent 76. In the exemplary embodiment, filter 78 includes a HEPA rated filter. In other embodiments, any filter configuration and/or rating can be used that enables air handling system 10 to function as described herein. Moreover, return assembly 43 includes damper 90 coupled in flow communication to first return duct 50 and between vent 76 and filter 78. In the exemplary embodiment, damper 90 is used when optional down range air secondary return/intake system 94 is utilized. Damper 90 can be manually controlled and/or automatically controlled. First return vent 76 is positioned in range area 20 and between shooter position 36 and downrange end 18 at an elevated position with respect to floor. First return vent 76 is positioned adjacent ceiling (not shown) and orientated toward range area 20. First return vent 76 is coupled in flow communication with range area 20. First return vent 76 can include any number of return vents 76 that enables air handling system 10 to function as described herein. Moreover, first return vent 76 can be located in any position and/or orientation within enclosure 14 to enable system 10 to function as described herein.

Air recirculation assembly 43 further includes circulating fan 52 coupled in flow communication to at least one of air handling unit 46, supply duct 48 and/or mixing plenum 60. Circulating fan 52 is sized to provide from about 40 feet per minute ("fpm") velocity to about 90 feet per minute ("fpm") velocity when energized. More particularly, circulating fan 52 is sized to provide from about 50 fpm velocity to about 75 fpm velocity. Alternatively, circulating fan 52 is sized to provide any air flow velocity to enable system 88 to function as described herein. Air recirculation assembly 43 includes a static pressure sensor 92 that is configured for circulating fan speed control. In the exemplary embodiment, air flow is maintained via at least static sensor 92 and variable frequency drive for fan speed control. Firing line velocity of airflow is maintained when used in conjunction with trap exhaust fan assembly 44 and air handling unit 46. Moreover, air recirculation assembly 43 includes a damper 90 coupled in flow communication to first return duct 50 and located between fan 52 and air handling unit 46. Damper 90 can be manually operated or motor or automatically operated.

First return vent 76 is configured to receive and channel first amount of discharged air 53 and contaminates present in range area 20 and into first return duct 50. Because first return duct 50 is in flow communication with at least fan 52, fan 52 is configured to further create a negative pressure with first return duct 50 to draw air and contaminants into first return duct 50 via first return vent 76. First return duct 50 channels first amount of discharged air 53 and contaminants through filter 78 which facilitates removing contaminants from first amount of discharged air. First return duct 50 channels filtered return air to at least one of air handling unit 46, supply duct 48 and mixing plenum 60 to facilitate re-circulating return air 53 with supply air.

Air recirculation assembly 43 further includes a secondary circulated dirty air pickup/return system 94 having a second return duct 96 that is configured to return a second amount of discharged air 55 present in range area 20 to at least one of air handling unit 46 and mixing plenum 60. Second return duct 96 includes an end 98 coupled in flow communication to first return duct 50 and second return vent 100 coupled to second return duct 96 and in flow communication with second return duct 96 and range area 20. Second return vent 100 is configured to receive and channel second amount of discharged air 55 and contaminates present in range area 20 and into second return duct 96. More particularly, second return vent 100 is configured to channel second amount of discharged air 55 and contaminants present in range area 20 between at least first return vent 76 and downrange end 18. In the exemplary embodiment, first amount of discharged air 53 is different than second amount of discharged air 55. More particularly, first amount of discharged air 53 is larger than second amount of discharged air 55. Alternatively, first amount of discharged air 53 is smaller or the same as second amount of discharged air 55. Because second return duct 96 is in flow communication with first return duct 50, fan 52 is configured to further create a negative pressure with second return duct 96 to draw air and contaminants into second return duct 96. Air recirculation assembly 43 includes a damper 90 coupled in flow communication to second return duct 96 and located between first return duct 50 and second return vent 100.

Air exhaust assembly 44 includes exhaust inlet/intake vent 80, exhaust outlet vent 82 and exhaust duct 84 coupled in flow communication to exhaust inlet vent 80 and exhaust outlet vent 82. In the exemplary embodiment, air exhaust assembly 44 includes trap exhaust fan 85 coupled in flow communication to exhaust duct 84. Exhaust inlet vent 80 is positioned within range area 20 and between first return vent 76 and downrange end 18 at an elevated position with respect to floor 28. In the exemplary embodiment, exhaust inlet vent 80 is positioned between second return vent 100 and downrange end 18. More particularly, exhaust inlet vent 80 is positioned near downrange end 18. Exhaust inlet vent 80 is positioned adjacent to ceiling and orientated toward and in flow communication with range area 20. Exhaust inlet vent 80 can include any number of vents that enables air handling system 10 to function as described. Exhaust inlet vent 80 can be located within enclosure 14 in any position and/or orientation to enable system 88 to function as described herein.

Exhaust inlet vent 80 is configured to receive a third amount of discharged air 57 and contaminants that flow past first return duct 50 and/or first return vent 76 and/or second return vent 100. Exhaust inlet vent 80 is configured to channel third amount of discharged air 57 and contaminants into exhaust duct 84. Exhaust duct 84 includes filter 86 located between exhaust inlet vent 80 and exhaust outlet vent 82. In the exemplary embodiment, filter 86 includes a HEPA rated filter. The efficiency of filter 86 can be regulated by local code authority. In other embodiments, any filter configuration and/or rating can be used that facilitates air handling system 10 to function as described herein. Exhaust duct 84 is configured to channel third amount of discharged air 57 through filter 86 and out of exhaust outlet vent 82. Filter 86 is configured to facilitate capturing a predetermined amount of contaminants from third amount of discharged air 57 prior to third amount of discharged air 57 exiting exhaust outlet vent 82 and into outside environment.

In the exemplary embodiment, air handling system 10 includes a controller 102 coupled to at least one of air supply assembly 42; air recirculation assembly 43 and air exhaust assembly 44. Controller 102 is configured to control the operation and/or settings of at least one of air supply assembly 42; air recirculation assembly 43 and air exhaust assembly 44 such that settings may be achieved by a system operator (not shown) for desired performance of air handing system 10.

Controller 102 includes a processor, such as a general purpose central processing unit (CPU), a graphics processing unit (GPU), a microcontroller, a reduced instruction set computer (RISC) processor, an application specific integrated circuit (ASIC), a programmable logic circuit (PLC), and/or any other circuit or processor capable of executing the functions described herein. The methods described herein may be encoded as executable instructions embodied in a computer readable medium, including, without limitation, a storage device and/or a memory device. Such instructions, when executed by a processor, cause the processor to perform at least a portion of the methods described herein. The above examples are exemplary only, and thus are not intended to limit in any way the definition and/or meaning of the term processor.

As used herein, the term processor is not limited to just those integrated circuits referred to in the art as a computer, but broadly refers to a microcontroller, a microcomputer, a programmable logic controller (PLC), an application specific integrated circuit, and other programmable circuits, and these terms are used interchangeably herein. In the embodiments described herein, memory may include, but is not limited to, a computer-readable medium, such as a random access memory (RAM), and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

Processors, as described herein, process information transmitted from a plurality of electrical and electronic devices. Memory devices (not shown) and storage devices (not shown) store and transfer information and instructions to be executed by the processors. Memory devices and the storage devices may also be used to store and provide temporary variables, static (i.e., non-volatile and non-changing) information and instructions, or other intermediate information to processor during execution of instructions by the processors. The execution of sequences of instructions is not limited to any specific combination of hardware circuitry and software instructions.

Figure 3:
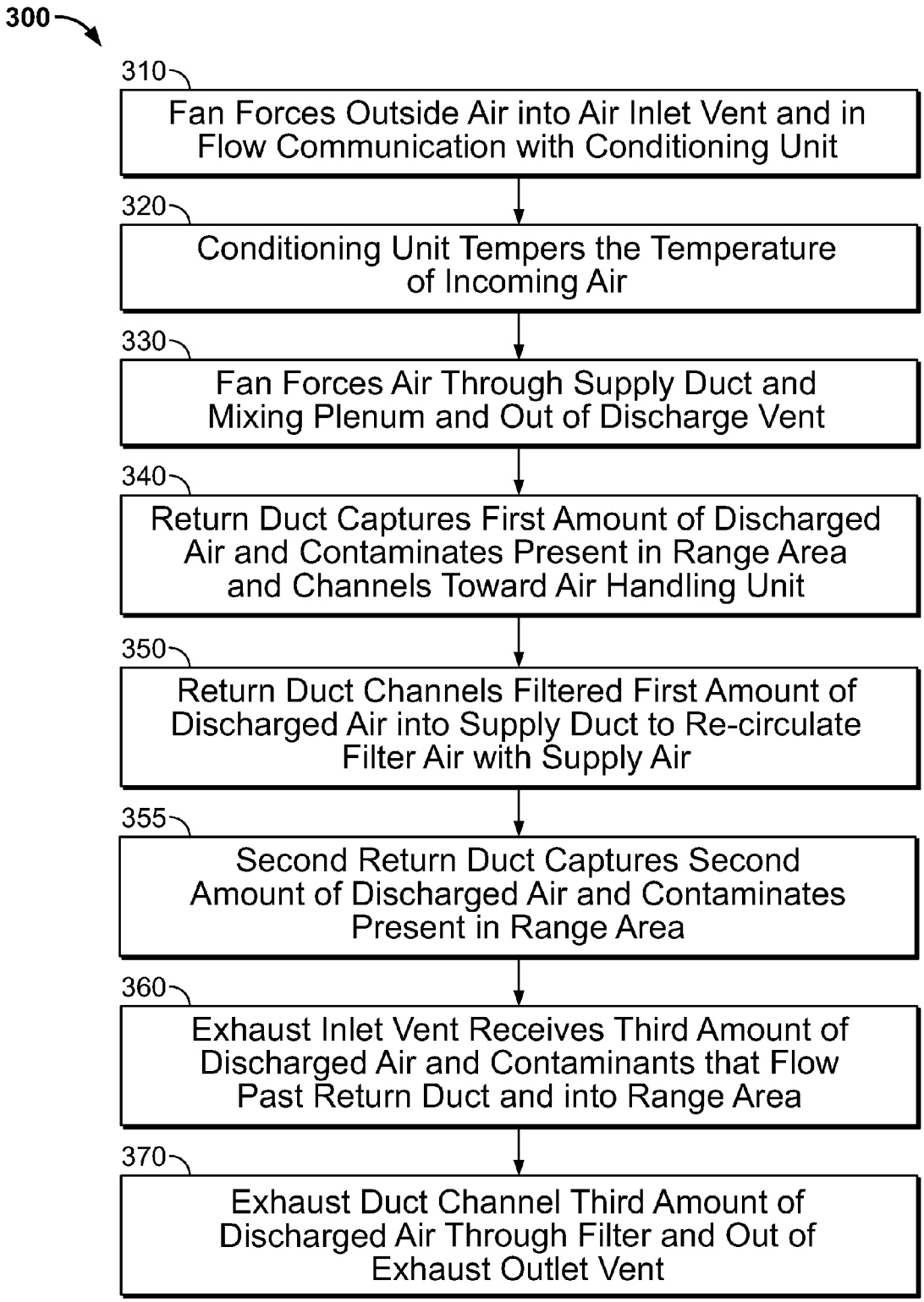
FIG. 3 is a flowchart of an exemplary method of operating an exemplary air handling system.

FIG. 3 is a flowchart 300 of an exemplary method of operating air handling system 10 (shown in FIG. 1) and/or air handling system 88 (shown in FIG. 2). During operation, outside air is drawn or forced 310 into air inlet vent 54 and in flow communication with conditioning unit 56. Conditioning unit 56 facilitates tempering 320 the temperature of incoming air. In the exemplary embodiment, conditioning unit 56 is configured to temper the air temperature from about 60° F. to about 85° F. More particularly, conditioning unit 56 tempers the air temperature from about 65° F. to about 80° F. and in particular from about 70° F. to about 75° F. In other embodiments, any air temperature can be used that facilitates air handling system 10 to function as described herein.

After air temperature is tempered, air is forced 330 through supply duct 48 and mixing plenum 60 and out of discharge vent 62. In the exemplary embodiment, each of first and second discharge vents 64 and 66 is configured to channel and discharge air toward shooter position 36 from about 2000 cubic feet per minute ("cfm") to about 8000 cubic feet per minute ("cfm"). More particularly, each of first and second discharge vents 64 and 66 is configured to channel and discharge air at about 3000 cfm. In the shooter area 30, discharged air mixes with contaminants from discharged firearms. Air handling system 10 facilitates integrating air velocity at shooting position 36 to carry dangerous airborne contaminates away from shooter area 30 to maintain a safe shooting environment while maintaining consistent air temperature for personal comfort.

First return duct 50 is configured to receive and capture 340 first amount of discharged air 53 and contaminates present in range area 20 and to channel first amount of discharged air 53 toward at least one of air handling unit 46 and mixing plenum 60. In the exemplary embodiment, first return duct 50 is configured to receive and channel from about 4000-5500 cfm of first amount of discharged air 53. More particularly, first return vent 76 is configured to receive and channel about 5000 cfm of first amount of discharged air 53 into air handling unit 46, first return duct 50 and/or mixing plenum 60 and through filter 78. First return duct 50 channels filtered first amount of discharged air 53 into supply duct 48 to facilitate re-circulating 350 filtered first amount of discharged air 53 with supply air. A portion of filtered first amount of discharged air 53 is channeled in flow communication with conditioning unit 56, which is configured to temper the temperature of filtered first amount of discharged air 53. Fan 52 facilitates mixing tempered filtered first amount of discharged air 53 with supply air and/or outside air for re-circulating filtered air.

In the exemplary embodiment, second amount of discharged air 55 is captured 355 by secondary return system 94 post filtration of first return vent 76 and circulated through conditioning unit 56 and/or mixing plenum 60 where second amount of discharged air 55 is tempered and mixed with a portion of outside air. In the exemplary embodiment, about 2100 cfm of second amount of discharged air 55 is captured and re-circulated through conditioning unit 56 and mixed with about 900 cfm of outside air. In other embodiments, other amounts of second amount of discharged air 55 are captured and mixed with other amounts of outside air. Any amounts of amount of second discharged air 55 can be channeled and mixed with any amount of outside air. The blended and tempered second amount of discharged air 55, for example about 3000 cfm, is re-introduced to the circulated air stream via air handling unit 46, supply duct 48 and/or mixing plenum 60, then reintroduced into shooter area 30 as previously described.

A third amount of discharged air 57 and contaminants flows into range area 20. In the exemplary embodiment, first return duct 50 and vents 76 and 100 are sized and shaped to facilitate allowing about 1000 cfm of third amount of discharged air 57 to migrate toward downrange end 18 to clear smoke and other visibility impediments within shooter area 30 with respect to visibility of downrange end 18. First return duct 50 and vents 76 and 100 are sized and shaped to facilitate allowing any amount of third amount of discharged air 57 to migrate downrange to clear smoke and other visibility impediments within shooter area 30 with respect to visibility of downrange end 18. Secondary system 94 is configured to receive air and contaminates that flow past first return duct 50 and/or first return vent 76 and into range area 20 to facilitate filtering and re-circulating air. Exhaust inlet vent 80 is configured to receive third amount of discharged air 57 and contaminants 360 that flow past first return duct 50 or first return vent 76 and/or second return duct 96 and/or second return vent 100 and into range area 20. Exhaust inlet vent 80 channels third amount of discharged air 57 and contaminants into exhaust duct 84. More particularly, exhaust duct 84 channels 370 third amount of discharged air 57 through filter 86 and out of exhaust outlet vent 82.

The embodiments described herein integrate adequate velocity at the shooter position to carry dangerous airborne contaminates away from the shooters to maintain a safe shooting environment while at the same time maintaining consistent air temperature and air flow for personal comfort; and accomplishing these parameters while considering upfront installation cost and legacy operating cost. The embodiments described herein facilitate maintaining adequate air flow within range to clear smoke and other contaminants for health and visibility concerns. Moreover, the embodiments described herein facilitate removing contaminants from air flow prior to exhausting the air flow from the range. The embodiments include safety devices and a start/purge sequence of initial operation to ensure cleanliness of the air within the range. The embodiments include temperature monitoring systems and flow monitoring systems to facilitate operation of air handling system.

A technical effect of the systems and methods described herein includes at least one of: (a) controlling air flow within an indoor facility; (b) filtering, removing and exhausting air and contaminants from the indoor facility and (c) improving efficiency of an air handling system and improving installation costs, startup costs, operating costs and maintenance costs of the air handling system and indoor facility.

Exemplary embodiments of systems and methods for an air handling system are described above in detail. The systems and methods are not limited to the specific embodiments described herein, but rather, components of systems and/or steps of the method may be utilized independently and separately from other components and/or steps described herein. Each component and each method step may also be used in combination with other components and/or method steps. Although specific features of various embodiments may be shown in some drawings and not in others, this is for convenience only. Any feature of a drawing may be referenced and/or claimed in combination with any feature of any other drawing.

Further, the embodiments described herein further treat environments beyond indoor gun ranges. For example, metal plating operations are well recognized sources of contaminated air, as are radiator repair and other lead uses, including certain flux cleaning operations, such as in the production of printed circuit boards and other electronic operations. Other industries or practices which produce contaminated air include biochemical operations and/or medical laboratories. The embodiments described herein are configured to facilitate treating at least these other environments.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An air handling system for handling air and contaminants within an enclosure of an indoor gun range, said air handling system comprising:

an air supply assembly comprising an air handling unit, wherein said air handling unit comprises a conditioning unit; and an air recirculation assembly comprising a filter, said air recirculation assembly couples in flow communication with the enclosure and said air supply assembly to filter air from the enclosure and recirculate the filtered air to said air supply assembly, wherein said air supply assembly couples in flow communication with the enclosure and said air recirculation assembly for channeling a first stream of filtered air from said air recirculation assembly ino said air handling unit to be conditioned by said conditioning unit, and for channeling a second stream of filtered air from said air recirculation assembly to bypass said air handling unit and mix with the conditioned first stream before the mixture is discharged into the enclosure.

2. The air handling system of claim 1, further comprising an air exhaust assembly that couples in flow communication with the enclosure.

3. The air handling system of claim 1, wherein said air supply assembly comprises a plenum for mixing the conditioned first stream with the bypassed second stream.

4. The air handling system of claim 1, wherein said conditioning unit is an air-heating unit.

5. The air handling system of claim 1, wherein said conditioning unit is an air-cooling unit.

6. The air handling system of claim 1, wherein said air handling unit is a rooftop unit.

7. The air handling system of claim 1, wherein the enclosure has an uprange end, a downrange end, and a shooter position between the uprange end and the downrange end, said air supply assembly comprising a discharge vent for discharging the mixture into the enclosure between the uprange end and the shooter position.

8. The air handling system of claim 1, wherein said air recirculation assembly comprises a fan downstream of said filter.

9. The air handling system of claim 1, wherein said air handling unit comprises an outside-air vent coupled in flow communication with said conditioning unit for channeling outside air into said conditioning unit and mixing the outside air with the first stream of filtered air.

10. The air handling system of claim 1, wherein said air supply assembly comprises a damper.

11. An indoor gun range comprising:

an enclosure;

an air supply assembly comprising an air handling unit, wherein said air handling unit comprises a conditioning unit;

an air recirculation assembly comprising a filter, said air recirculation assembly coupled in flow communication with said enclosure and said air supply assembly to filter air from said enclosure and recirculate the filtered air to said air supply assembly, wherein said air supply assembly is coupled in flow communication with said enclosure and said air recirculation assembly for channeling a first stream of filtered air from said air recirculation assembly into said air handling unit to be conditioned by said conditioning unit, and for channeling a second stream of filtered air from said air recirculation assembly to bypass said air handling unit and mix with the conditioned first stream before the mixture is discharged into said enclosure.

12. The indoor gun range of claim 11, further comprising an air exhaust assembly coupled in flow communication with said enclosure.

13. The indoor gun range of claim 11, wherein said air supply assembly comprises a plenum for mixing the conditioned first stream with the bypassed second stream.

14. The indoor gun range of claim 11, wherein said conditioning unit is an air-cooling unit.

15. The indoor gun range of claim 11, wherein said air handling unit is a rooftop unit.

16. The indoor gun range of claim 11, wherein said enclosure has an uprange end, a downrange end, and a shooter position between said uprange end and said downrange end, said air supply assembly comprising a discharge vent for discharging the mixture into said enclosure between said uprange end and said shooter position.

17. The indoor gun range of claim 11, wherein said air handling unit comprises an outside-air vent coupled in flow communication with said conditioning unit for channeling outside air into said conditioning unit and mixing the outside air with the first stream of filtered air.

18. A method of assembling an air handling system for an enclosure of an indoor gun range, said method comprising:

coupling an air supply assembly in flow communication with the enclosure, wherein the air supply assembly includes an air handling unit that has a conditioning unit;

coupling an air recirculation assembly in flow communication with the enclosure, wherein the air recirculation assembly has a filter for filtering air from the enclosure; and coupling the air supply assembly in flow communication with the air recirculation assembly for channeling a first stream of filtered air from the air recirculation assembly into the air handling unit to be conditioned by the conditioning unit, and for channeling a second stream of filtered air from the air recirculation assembly to bypass the air handling unit and mix with the conditioned first stream before the mixture is discharged into the enclosure.

19. The method of claim 18, further comprising coupling a plenum of the air supply assembly in flow communication with the air recirculation assembly such that the plenum is downstream of the conditioning unit for mixing the conditioned first stream with the bypassed second stream in the plenum.

20. The method of claim 18, further comprising coupling the air handling unit in flow communication with outside air for channeling outside air into the conditioning unit and mixing the channeled outside air with the first stream of filtered air.

* * * * *